United States Patent [19]

Boschetti

[11] 4,337,607

[45] Jul. 6, 1982

[54] TONGUE AND GROOVE BOARDS WITH SPACERS PERMITTING EXPANSION, AND METHOD OF MAKING THE SAME

[76] Inventor: Giovanni Boschetti, 6911 Vezio, Switzerland

[21] Appl. No.: 135,145

[22] Filed: Mar. 28, 1980

[30] Foreign Application Priority Data

Apr. 23, 1979 [CH] Switzerland ..... 3879/79

[51] Int. Cl.[3] ..... E04C 1/30

[52] U.S. Cl. ..... 52/573; 52/595

[58] Field of Search ..... 52/592, 595, 593, 589, 52/393, 403, 98, 573; 144/309 D, 309 L; 403/364, 248

[56] References Cited

U.S. PATENT DOCUMENTS

| | | | |
|---|---|---|---|
| 158,998 | 1/1875 | Sturevant | 144/309 D |
| 2,004,193 | 6/1935 | Cherry | 52/595 |
| 2,111,003 | 3/1938 | Petty | 52/392 |
| 3,566,542 | 3/1971 | Gillen | 52/400 |
| 3,987,599 | 10/1976 | Hines | 52/595 |
| 4,095,913 | 6/1978 | Pettersson | 52/593 |
| 4,265,067 | 5/1981 | Palmer | 52/309.9 |

*Primary Examiner*—John E. Murtagh

*Attorney, Agent, or Firm*—Young & Thompson

[57] ABSTRACT

Tongue and groove boards are provided with integral spacers that permit expansion of the assembled boards without buckling, by milling on the bottom of the groove a central longitudinally extending rib of triangular cross section. Spaced portions of the rib, of total length that is most of the length of the board, are then compressed to the level of the bottom of the groove, thereby leaving a series of relatively weak projections which serve to space the boards apart the necessary distance during assembly, but which are not strong enough to resist compression upon expansion of the boards under the influence of moisture or temperature.

2 Claims, 5 Drawing Figures

TONGUE AND GROOVE BOARDS WITH SPACERS PERMITTING EXPANSION, AND METHOD OF MAKING THE SAME

It is known that, in the assembly of tongue and groove boards, an interspace of about 1–2 mm must be maintained between what would otherwise be abutting surfaces of adjacent boards, in order to allow for expansion due to swelling caused by humidity or by a rise in temperature, without buckling the assembly of the boards.

In the past, it has been necessary to fit spacers between the boards in order to achieve this; and this is of course time consuming and expensive.

The present invention avoids this additional expense, by providing on what would otherwise be abutting surfaces of the boards, projections which have a low mechanical resistance to compression. During assembly of the boards, these projections space the boards apart at the proper mutual distance, but compress during expansion of the boards, thereby preventing buckling of the assembly of boards.

It is accordingly an object of the present invention to provide a method of making tongue and groove boards, and to provide boards made by that method, in which the spacing projections are formed from at least one of the parts forming the joint, these projections being adapted to keep the adjacent boards spaced apart at the proper distance during assembly but allowing compression of the projections during expansion of the boards, thereby to prevent buckling.

In accordance with a preferred embodiment of the invention, the projections are spaced apart and formed from a continuous rib of preferably triangular cross section, which has been formed on the bottom of the groove of each board.

The rib is formed by milling, the mill thus having peripheral V-shaped grooves if the rib is to be triangular. The spacing of the projections is obtained by compressing the rib by means of a disc which has at its periphery the contour of the groove without the rib, and which has spaced apart about its periphery a plurality of recesses whose peripheral extent is less than the spacing between the recesses, whereby the disc between the recesses compresses the rib to the level of the floor of the groove and leaves spaced projections at the locations of the recesses on the disc.

These and other objects, features and advantages of the present invention will become apparent from a consideration of the following description, taken in connection with the accompanying drawing, in which.

Figure 1:
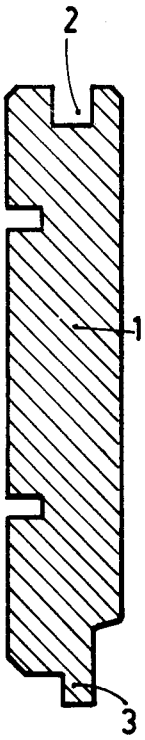
FIG. 1 is a cross-sectional view of a known type of tongue and groove board.

Referring now to the drawings in greater detail, and first to FIG. 1 thereof, there is shown a cross section of a board 1 of known type, generally of deal, commonly called "matchboard", having a groove 2 extending lengthwise thereof along one edge and a tongue 3 extending lengthwise thereof along the other edge of the board.

Figure 2:
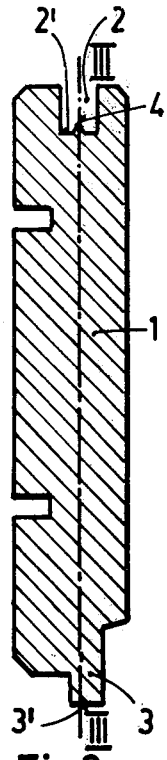
FIG. 2 is a cross section of a board according to the present invention, at an intermediate stage of manufacture, that is, having a rib at the bottom of the groove.

According to the present invention, as seen in FIG. 2, groove 2 is deepened by means of a mill (not shown) modified for this purpose so as to form on the bottom 2' of the groove a continuous rib 4 which is preferably of triangular cross section.

Figure 3:
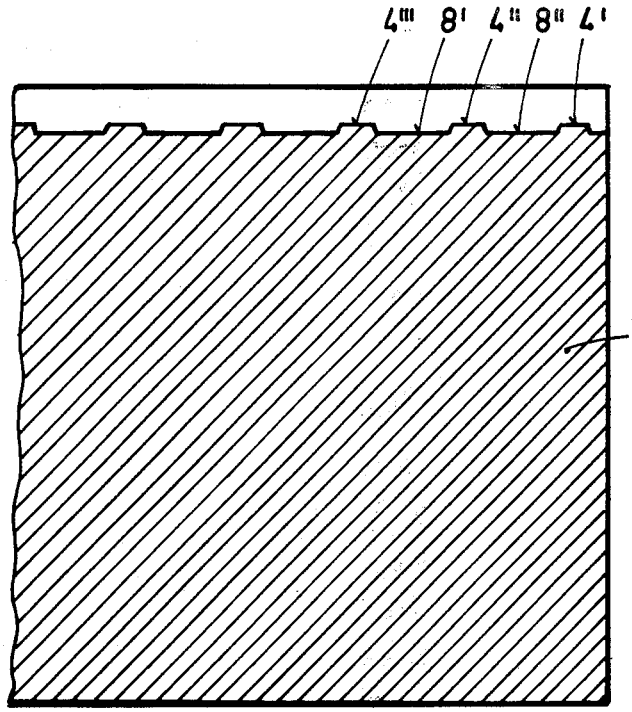
FIG. 3 is a cross-sectional view taken on the line III—III of FIG. 2, and showing the completed board according to the present invention, that is, having spaced projections at the bottom of the groove.
Figure 4:
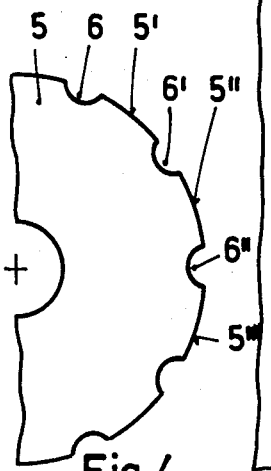
FIG. 4 is a fragmentary elevational view of the disc used to flatten spaced portions of the rib so as to obtain spaced projections at the bottom of the groove.

Rib 4 is then flattened at spaced intervals with the disc 5 shown in FIG. 4. Disc 5 has peripheral cavities 6, 6', 6'' but is otherwise of cylindrical cross-sectional configuration, these cavities being spaced apart by part-cylindrical sections 5', 5'' which serve to compress rib 4 along the lines 8', 8'' shown in FIG. 3, so as to leave projections 4', 4'', 4''' spaced apart from each other a distance greater than the length of the projections. In other words, most of rib 4 has been flattened by disc 5.

Figure 5:
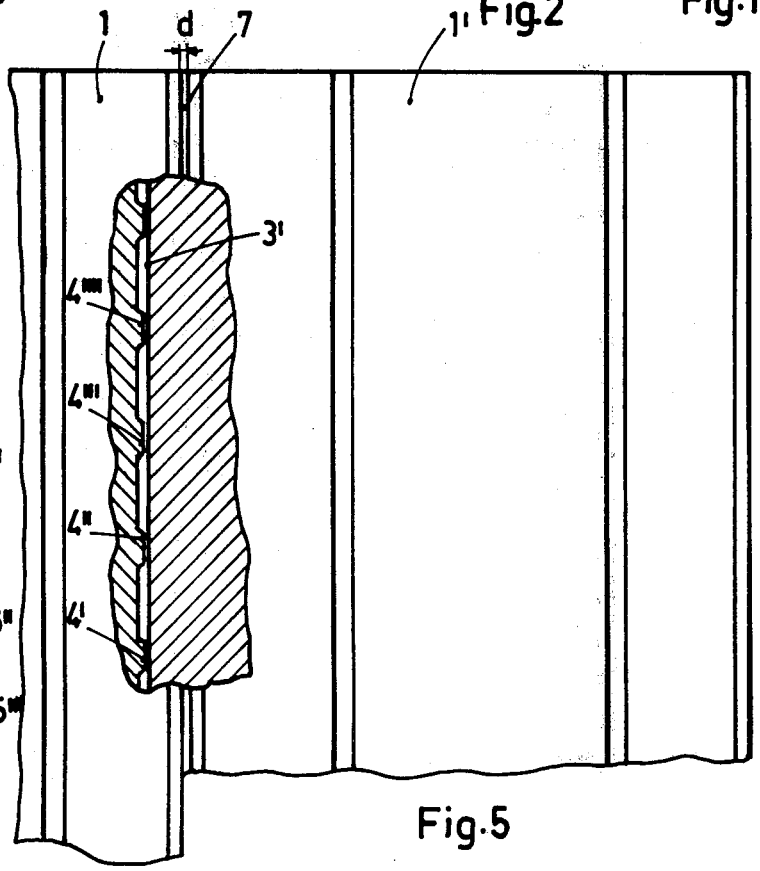
FIG. 5 is a plan view, with parts broken away, of an assembly of tongue and groove boards according to the present invention.

The assembly of the boards is shown in FIG. 5. By assembling two boards 1, 1' like those shown in FIG. 3, the tongue 3 of one board penetrates into the groove 2 of the other until the edge 3' of the tongue comes into contact with projections 4', 4'', etc. of the other board, the two boards 1 and 1' are automatically mutually spaced to provide a space 7 therebetween, that is, by a distance "d" which allows for expansion of the boards without causing buckling and without the need to use separate spacers during assembly of the boards.

Thus, when the boards expand, for example by swelling as a result of humidity or increase in temperature, the projections 4', 4'', etc. compress easily in view of their low mechanical resistance to compression, and space 7 closes.

From a consideration of the foregoing disclosure, therefore, it will be evident that the initially recited object of the present invention has been achieved.

Although the present invention has been described and illustrated in connection with a preferred embodiment, it is to be understood that modifications and variations may be resorted to without departing from the spirit of the invention, as those skilled in this art will readily understand. For example, the boards of the present invention can be not only of wood, but also of composites such as particle board or chip board or the like. Also, the projections 4', 4'', etc. can be formed instead on edge 3' of tongue 3. These and other modifications and variations are considered to be within the purview and scope of the present invention as defined by the appended claims.

What is claimed is:

1. A tongue and groove board having confronting surfaces when assembled with adjacent said boards, having on the bottom of the groove of each said board a plurality of projections which are spaced apart at their bases in the direction of the length of the board and which are of such low mechanical resistance to compression that an assembly of the boards will expand by compressing said projections rather than by buckling, the interval between bases of the projections being greater than the length of the projections in the direction of the length of the board, said intervals having been formed by compression of the material of the board between the projections.

2. A board as claimed in claim 1, in which said projections are of triangular cross-sectional configuration.

* * * * *